United States Patent [19]

Simon

[11] Patent Number: 4,925,684

[45] Date of Patent: May 15, 1990

[54] FOOD PACKAGE WITH A MICROWAVE RELEASABLE SEALED CLOSURE

[75] Inventor: Frederick E. Simon, Lindenwold, N.J.

[73] Assignee: Campbell Soup Company, Camden, N.J.

[21] Appl. No.: 234,149

[22] Filed: Aug. 19, 1988

[51] Int. Cl.[5] ..... B65B 25/22

[52] U.S. Cl. ..... 426/107; 426/113; 426/243; 426/234; 229/125.35; 229/903

[58] Field of Search ..... 426/107, 113, 243, 234; 229/125.35, 903; 156/69, 78, 79, 125.4; 428/317.9; 521/92

[56] References Cited

U.S. PATENT DOCUMENTS

| | | | |
|---|---|---|---|
| 3,276,900 | 10/1966 | Funck | 117/93.1 |
| 3,865,302 | 11/1972 | Kane | 229/43 |
| 4,013,798 | 3/1977 | Goltsos | 426/107 |
| 4,210,674 | 7/1980 | Mitchell | 426/107 |
| 4,404,241 | 9/1983 | Mueller et al. | 428/35 |
| 4,469,258 | 9/1984 | Wright et al. | 229/43 |
| 4,521,466 | 6/1985 | White | 428/35 |
| 4,563,482 | 1/1986 | Tanizawa et al. | 521/92 |
| 4,640,838 | 2/1987 | Isakson et al. | 426/107 |
| 4,656,325 | 4/1987 | Keefer | 426/107 |
| 4,676,857 | 6/1987 | Scharr et al. | 156/233 |

*Primary Examiner*—Donald E. Czaja
*Assistant Examiner*—Evan Federman
*Attorney, Agent, or Firm*—Banner, Birch, McKie & Beckett

[57] ABSTRACT

The present invention provides a food package useful for heating a food product in a microwave oven. The package has a tray with an opening for introducing the food product therein. Once the food has been introduced into the tray, the opening is sealed using a microwave releasable adhesive. The microwave releasable adhesive seal includes a microwave interactive material in close proximity to a heat-releasable resin containing a blowing agent. The microwave interactive material preferably is composed of metallic flakes which become hot when exposed to microwave energy. Consequently, when the package is heated in a microwave oven, the microwave interactive material becomes hot, causing the blowing agent to decompose and form a gas. The gas formation destroys the integrity of the seal between the tray and the closure, permitting the seal to be opened easily after heating in a microwave oven.

27 Claims, 4 Drawing Sheets

FOOD PACKAGE WITH A MICROWAVE RELEASABLE SEALED CLOSURE

BACKGROUND OF THE INVENTION

1. Field of the Invention

This invention relates to a food package useful for microwave heating applications, and particularly to a container or tray having a sealed closure which becomes easier to open upon microwave heating.

2. Description of the Related Art

There has been much interest recently in food packaging materials for foods cooked in a microwave oven. U.S. Pat. No. 4,267,420, to Brastad, discloses a food product wrapped with plastic film having a very thin microwave interactive coating. The film conforms to a substantial portion of the food product. The coating converts some of the microwave energy into heat which is transmitted directly to the food surface so that a browning and/or crisping is achieved.

U.S. Pat. No. 4,676,857, to Scharr, discloses a microwave heating material and method for its preparation. A preselected metallized pattern, such as dots, spirals, or circles, is disposed on at least a portion of a dielectric material. The dielectric material may be in the form of a flexible wrap.

Other inventions have used the fact that various polymeric materials lose strength at elevated temperatures to perform useful packaging functions. U.S. Pat. No. 4,404,241, to Meuller et al., discloses a microwave package with a means for venting vapor. The vent is in the form of an aperture in the multilayer sheet which forms the package, and is covered with a continuous sealing layer of an extrudable hot melt material. When this material is subjected to slight pressure in combination with heat, softening and flow occurs at temperatures effective to permit venting of steam or other vapor without sufficient pressure build-up to distort the package.

U.S. Pat. No. 4,561,337, to Cage et al., discloses a bag containing a mixture of edible popcorn ingredients suitable for use in microwave ovens. Portions of the panels of the bag contain a coating that is sensitive to pressure and heat, forming a seal along the top edge of the panels. The seal has sufficient strength to withstand the internal steam pressure generated by the moisture content of the kernels for at least one-half of the popping process. Preferably, the bag will vent at the top seam before the process is completed to allow steam to escape.

Food packages sealed using conventional techniques, such as heat sealing a lid to a flange surrounding the opening of a tray using a synthetic resin as the adhesive, can be difficult to open along the seal. A consequence of this construction is that a significant tearing force is required to break the seal and thus the package must be fabricated using material of a sufficient thickness to resist deformation during opening by the consumer. In part, such seals are employed to ensure that the food remains securely sealed during the manufacturing and handling steps which are performed after the food product has been placed in the package and sealed. One manufacturing step which may be performed after sealing the package is heat pasteurization or heat sterilization. Unfortunately, containers securely sealed in this fashion present difficulties for consumers in opening the container after microwave heating. This is especially troublesome when the food product is, at least in part, in liquid form, for example as is encountered in soups, stews and products with gravy. Opening the sealed containers of the prior art often result in spillage of the liquid food product.

Some food containers for microwave applications are designed, for example with perforated lids, to avoid this problem and their lids or closures are at least partially removed prior to microwave heating, in order, inter alia to permit steam generated during microwave heating to be vented and to facilitate further opening after microwave heating. Unfortunately, with these containers there is a problem with spillage prior to heating, and product loss during heating, e.g. by splattering, is also a problem.

The prior art also has followed other approaches. U.S. Pat. No. 4,605,142 to Itoh et al., for example, describes a package or container having a continuous ridge extending along a flange at the opening of a tray. The ridge has a projection extending toward the outer periphery of one or both sides of the tray. The ridge has the effect of reducing the area of the seal. By reducing the total area (width) of the seal in combination with the projection, the force required to initiate opening and to propagate the opening of the closure is purportedly reduced.

U.S. Pat. No. 3,217,871 describes using an adhesive for sealing a package, which remains partially nonadherent through the sealing operation. In one embodiment, one of the opposing sealing surfaces has a discontinuous adhesive coating, while the other surface has a continuous adhesive coating. A problem with this approach is premature opening of the seal.

The present invention, in contrast, provides a sealed food package or container for use in a microwave oven which is sealed securely during packaging and which remains securely sealed during conventional heat processing operations and subsequent handling. A novel feature of the package is that the seal becomes more easy to open upon heating in a microwave oven so as to facilitate opening of the container by the consumer. The present invention further provides a package which permits venting of steam generated in the package such as by the food product during heating.

SUMMARY OF THE INVENTION

The present invention provides a food package which is useful for heating a food product in a microwave oven. The package comprises:

(a) a tray for containing the food product before and during microwave heating, the tray having a continuous sealing surface which defines an opening for introducing the food product into the tray and for removing the food product therefrom;

(b) a closure for covering the opening of said tray; and (c) a microwave releasable adhesive seal in heat sealed contact with the continuous sealing surface of the tray and the closure to seal the food product in said tray:

said microwave releasable adhesive seal comprising a microwave interactive material in close proximity to a heat-sealable resin containing a blowing agent, wherein the blowing agent forms a gas during microwave heating of the package and the seal becomes selectively releasable upon exposure of the package to microwave energy and resultant heating of the food product under microwave heating conditions.

The present invention further provides an improved method of making a packaged food product suitable for heating in a microwave oven having a microwave releasable sealed closure. The method comprises (a) providing a tray having a continuous sealing surface which defines an opening into the tray and a closure for sealing the opening of said tray, (b) introducing food into the tray through said opening;

(c) covering said opening with the closure and heat sealing the closure to said continuous sealing surface to seal the food product within the tray; and (d) heat processing the sealed container, and the improvement comprises;

sealing the closure to said continuous sealing surface with a heat-sealable resin containing a blowing agent and, providing a microwave interactive material in close proximity to the heat-sealable resin, the blowing agent being able to form a gas during microwave heating of the packaged food product but being substantially unable to form a gas during heat sealing of the closure and during heat processing of the packaged food product.

DETAILED DESCRIPTION OF THE INVENTION

Figure 1:
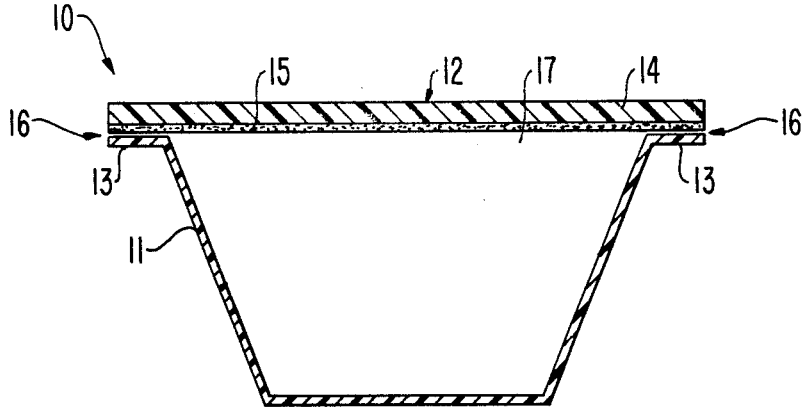
FIG. 1 is a cross sectional view of a food package according to the present invention.
Figure 2:
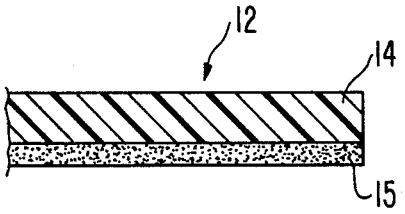
FIG. 2 is an expanded cross sectional view of the closure for the tray shown in FIG. 1.
Figure 3:
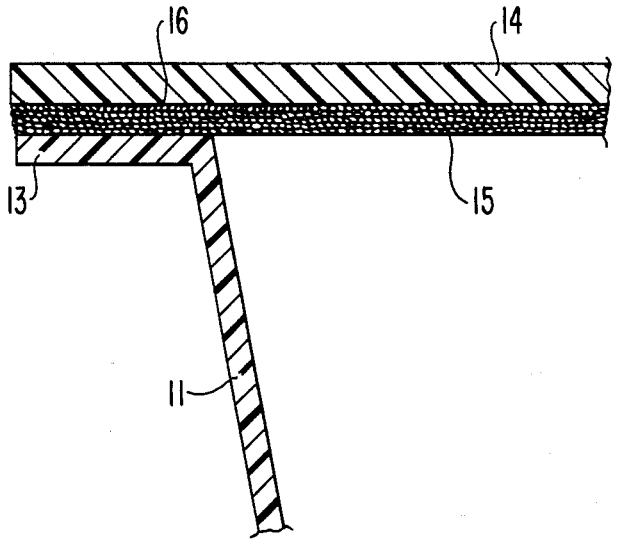
FIG. 3 is an expanded cross sectional view of the microwave releasable seal after microwave heating between the closure and the tray shown in FIG. 1.

One embodiment of the food package of the present invention is illustrated in FIGS. 1–3. Package or container 10 comprises an open container body or tray 11, having a continuous sealing surface or annular flange 13 defining and surrounding an opening 17. A closure or lid 12 is provided to close and seal the opening 17 by mating with flange 13. In the broad practice of the present invention, a microwave releasable adhesive seal maintains the closure or lid 12 in heat sealed contact with flange 13 of tray 11. In the FIGS. 1 to 3 embodiment, the closure or lid 12, as best shown in FIG. 2, comprises a support layer 14 and a heat-sealable resin layer or thermal sensitive adhesive 15. Generally, the heat-sealable resin need only be disposed on the periphery of support layer 14 of closure 12 that contacts flange 13. Closure or lid 12 then is heat sealed along the entire circumference of flange 13 using conventional heat sealing equipment. The heat-sealable resin layer or thermal sensitive adhesive 15 also could be supplied on flange 13, and still other arrangements will be recognized by the those skilled in the art.

The container body or tray 11 may be composed of any conventional packaging material which is compatible with the food to be heated in the microwave oven and the conditions encountered during microwave heating. The flange 13 of the tray also must be able to form a seal with closure 12. The tray may be composed of a thermally stable, microwave transparent plastic and paperboard materials, for example paper, molded cellulosic fiber, cardboard, paperboard, plastic, glass and ceramic. For example, the tray may be molded from a flexible plastic material such as polyethylene or polypropylene. A preferred material from a cost and appearance standpoint is thermoformed polypropylene. The tray 11 may also contain an oxygen barrier material such as an ethylene/vinyl alcohol copolymers, nylon, polyvinylidene chloride and/or similar materials which are transparent to microwave energy and provide a barrier to the ingress of atmospheric oxygen. In certain configurations, portions of tray 11 also may be coated or otherwise composed of a microwave reflective material to act as a selective shield during microwave heating.

In the FIGS. 1 to 3 embodiment, closure or lid 12 is a multiple layer structure and includes a support layer 14, which may be composed of paper or a plastic film of a thermally stable polymer, and a heat-sealable resin layer or thermally-sensitive adhesive 15. By the term "thermally stable" is meant a material which substantially maintains its structural and dimensional integrity under microwave heating conditions for expected microwave heating times. A thermally stable polymer film suitable for support layer 14 should withstand temperatures of at least about 200° C. for ten minutes or more without experiencing substantial deformation. One such material is a polyethylene terepthalate having a thickness of 0.0125 cm or greater, which has a melting point in the range of 250°–260° C. Other suitable films for preparing the support layer include those made from polyesters, polymethylpentene, polyarylates, polyamides, polyimides, polycarbonates, or cellophane. The lid also can be molded from a flexible plastic such as polyethylene or polypropylene. The support layer 14 or lid 12 also could itself have a laminate structure such as a polyester coated paperboard. In preferred practice, the lid has a rigid or semi-rigid construction.

The lower surface of support layer 14 in the FIGS. 1–3 embodiment is coated with a layer 15 of a heat-sealable thermoplastic polymer resin. In order to form the heat-sealable polymer resin layer 15, about 2–3 g/m$^2$ of the heat-sealable resin is typically applied to support layer 14 in that region of the layer which contacts the continuous sealing surface or annular flange 13 of the tray. As noted above, the heat-sealable resin layer also could be applied to flange 13 of tray 12. By the term "heat-sealable" is meant a material which can melt to form a seal at a temperature above ambient conditions. Thus, the closure can be sealed to the tray by heating the heat-sealable resin material above a certain temperature, and applying a suitable force to hold the surfaces to be sealed together, until a seal is formed.

A number of such heat-sealable, thermoplastic polymers useful for the microwave releasable adhesive seal of the present invention are known, including polyethylene, polypropylene, ethylene copolymers such as ethylene vinyl acetate copolymers, polyvinylidene chloride, polypropylene copolymers, epoxies, thermoplastic polyesters having melting points of about 50° C. to 200° C. and the like. Examples of preferred heat-sealable polymers are propylene resins. By the term "propylene resin" is meant a resin composed mainly of propylene units. More specifically, examples of propylene resins are polypropylenes, mixtures of polypropylene with other resins, and copolymers of propylene with monomers copolymerizable with propylene. An ethylene/propylene copolymer having an ethylene unit content of 5 to 40% by weight and a mixture of polyethylene and polypropylene is preferably used. An ethylene/propylene copolymer having an ethylene unit content of about 20% by weight is especially preferred. Customary amounts of other materials, such as processing aids, antioxidants, fillers, etc., may also be present in the heat-sealable thermoplastic resin.

The heat-sealable polymer of the microwave releasable adhesive seal preferably should have a peel strength of at least about 1000 N/m (about 2600 g/inch) at room temperature, and more preferably at least about 2000 N/m (about 5200 g/inch) before microwave exposure. Samples for a measurement of peel strength can be prepared by heat sealing two films using the heat-sealable polymer as the seal. For example, using a preferred polypropylene resin as the heat-sealable resin, the two films can be sealed together at about 160° C. for about 0.5 second at 340 kPa (50 psig). The peel strength can be measured with a Model 1120 Instron, using a Thomas M. Rhodes atmosphere control chamber for temperature control. The peel strength of such samples is relatively independent of microwave interactive materials being present or absent from the heat-sealable resin layer 15. After microwave exposure the peel strength should decrease to about 900 N/m (about 2300 g/inch) and preferably to below about 500 N/m (about 1300 g/inch).

In accordance with the present invention, the microwave releasable seal comprises a microwave interactive material in close proximity to a heat-sealable resin layer 15 containing a blowing agent.

Suitable microwave interactive materials for use in the present invention are metallic and non-metallic conductive materials. Suitable metallic microwave interactive materials include aluminum, nickel, antimony, copper, molybdenum, iron, chromium, tin, zinc, silver, gold, and various alloys of these metals, in flake or powdered form. Graphite and carbon black are common non-metallic microwave interactive materials. Preferably the microwave interactive material is aluminum.

The microwave interactive material is situated in close proximity to the heat-sealable resin. The term "close proximity" is intended to mean sufficient contact or spatial relationship between the microwave interactive material and the heat-releasable resin containing the blowing agent that the heat generated by or from the microwave interactive material is transferred to the heat-releasable polymer to soften the polymer and activate the blowing agent, i.e. cause the release of a gas, as will be described in more detail hereafter. In this way, the resin containing the blowing agent is heated sufficiently to cause the seal to loosen during microwave exposure.

Such close proximity can be obtained for example, by vacuum depositing or sputtering a microwave interactive material on at least one of the mating surfaces of the tray 11 and the closure or lid 12 forming the seal of package 10; by applying a coating of the microwave interactive material on the heat-releasable resin; by embedding or blending the microwave interactive material, e.g. in the form of flakes within the layer of heat-releasable resin which forms the seal and the like. When the microwave interactive material is in the form of metallic flakes, the flakes preferably have an aspect ratio of at least about 10, and will preferably have a diameter of about 1 to about 48 micrometers, and a thickness of about 0.1 to about 0.5 micrometers. In order to obtain uniformity in heating, it is preferred that the flakes be approximately circular, having an ellipticity in the range of about 1:1 to 1:2.

In the FIGS. 1 to 3 embodiment, the layer 15 preferably comprises about 5 to 80% by weight of microwave interactive material, in flake or powdered form, blended, dispersed or embedded in about 95 to 20% by weight of the heat-sealable thermoplastic resin material based on the combined weight of resin and microwave interactive material. Thus, the microwave interactive materials is provided in an amount of about 5–400% by weight of heat sealable resin. More preferably, the relative amount of microwave interactive material will be about 25 to 80% by weight, and most preferably about 30 to 60% by weight of the layer 15. The layer 15, of course, should not contain too high a concentration of microwave interactive material. In such a situation so much heat may be generated during microwave heating that the closure or lid 12 or the food product within package 10 is damaged. The appropriate parameters are readily determined by one skilled in the art. Generally, an arrangement which produces a temperature of greater than about 120° C. and more preferably on the order of about 160° C., in the heat-releasable resin within about one minute after exposure to microwave of a 700 W oven should be satisfactory.

When applying the microwave interactive material as a coating on closure or lid 12 it may be preferred to extend the coating over the entire surface and not just in the vicinity of the seal. In this way, in addition to activating the blowing agent, the microwave interactive material also may serve the dual purpose of an oxygen barrier and a browning aid. When applying the microwave interactive material as a coating, coating thickness of about 0.01 mm to about 0.25 mm should be suitable. The surface weight of the coating in such cases will be about 2.5 to 100 grams per square meter ($g/m^2$); preferably about 10 to about 85 $g/m^2$.

The thickness of the heat-sealable resin layer 15, the concentration of microwave interactive material therein, and the microwave absorption properties of the microwave interactive material should be sufficient to heat the heat-sealable thermoplastic layer 15 to above the decomposition temperature of a blowing agent incorporated in layer 15 during exposure of the food package to microwave heating conditions, as will be described in more detail hereinafter. Optionally, the microwave interactive material may provide additional heat to cook, brown and/or crispen the surface of any food item in the container 10, when the container 10 is exposed to the microwave energy. As noted above, in this latter case it may be desirable to have the resin layer containing the microwave interactive material over the entire surface of the closure or lid 12.

As noted above, the heat-sealable resin of the microwave releasable adhesive seal also contains a blowing agent. The blowing agent is a material which forms a desired amount of a gas by chemical means (e.g. decomposition) or physical means (e.g. vaporization) within the time and temperature conditions encountered during microwave heating of the food product. The time and temperature conditions needed to generate the desired amount of gas from the blowing agent should be more severe than the time and temperature conditions to which the heat-sealable resin layer is exposed during the manufacture and processing of the food package 12, so that premature gassing of the blowing agent is avoided. As noted, the time and temperature conditions that cause the desired gassing of the blowing agent should be similar to those encountered when the heat-sealable resin layer is heated by the microwave interactive material during heating of the food product in a microwave oven.

Of course, the gas generated by the blowing agent preferably should be unobjectionable from the standpoint of food contamination. Examples of such unobjectionable gases included nitrogen, carbon dioxide and oxygen.

Typically, the food package of the present invention is heat treated or processed, e.g. pasteurized or sterilized after being sealed with a food product, at a temperature in the range of about 100°-125° C. for times in the range of about 3 to 90 minutes. Thus, it is important that the blowing agent form an insignificant quantity of gas when the package is exposed to such heat treatment conditions, such as temperatures up to about 120°-125° C.

Also, heat sealing operations typically subject the food package of the present invention to a temperature on the order of about 190° C. for very short time periods in the area of the annular heat seal 16. During heat sealing, the heat-sealable resin layer thus is typically heated to about 190° C. for up to several seconds. It is important that the blowing agent used in the present invention form only a minor amount of gas during the heat-sealing operation.

Figure 4:
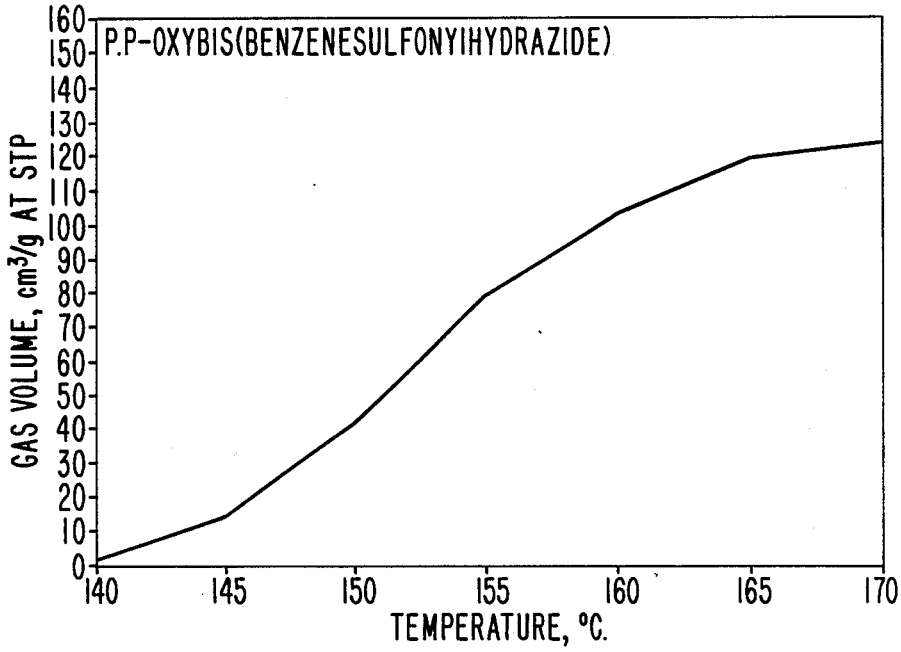
FIG. 4 is a graph of nitrogen gas volume release versus temperature for the blowing agent p,p-oxybis(benzene sulfonylhydrazide).
Figure 5:
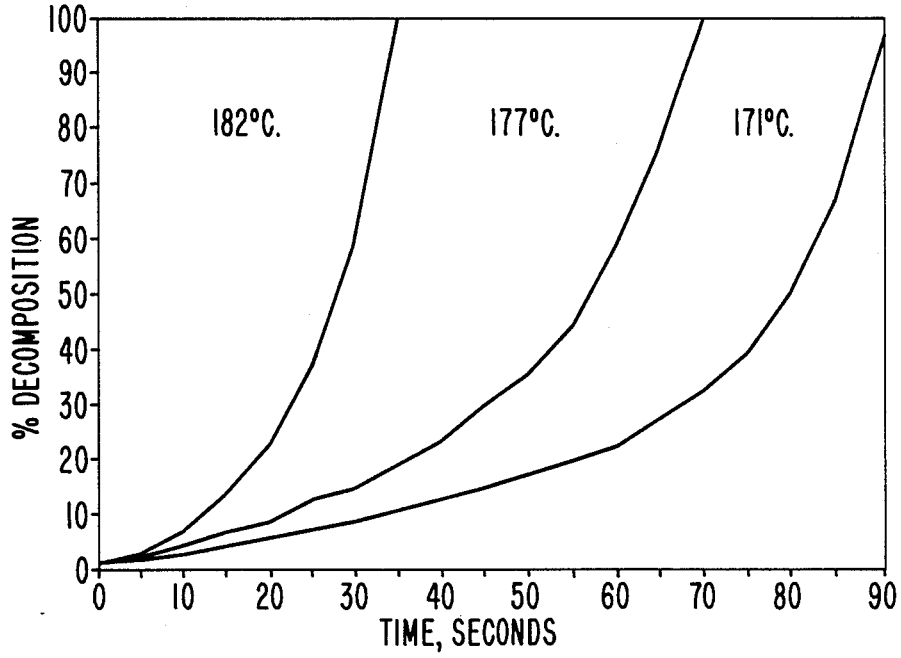
FIG. 5 is a graph of percent decomposition versus time for the blowing agent p,p-oxybis(benzene sulfonylhydrazide), plotted at different temperatures.
Figure 6:
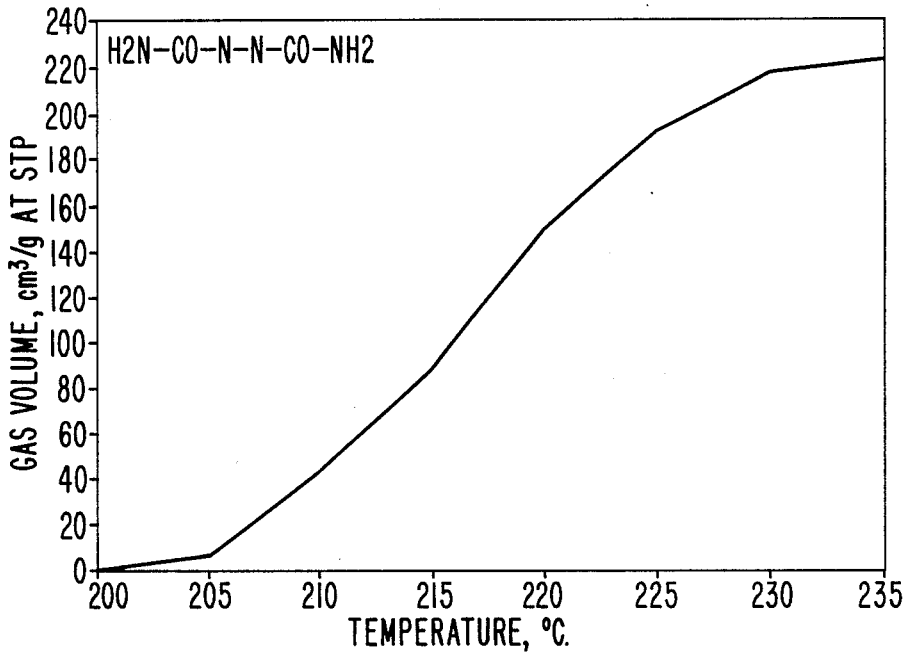
FIG. 6 is a graph of nitrogen gas volume release versus temperature for the blowing agent azodicarbonamide.
Figure 7:
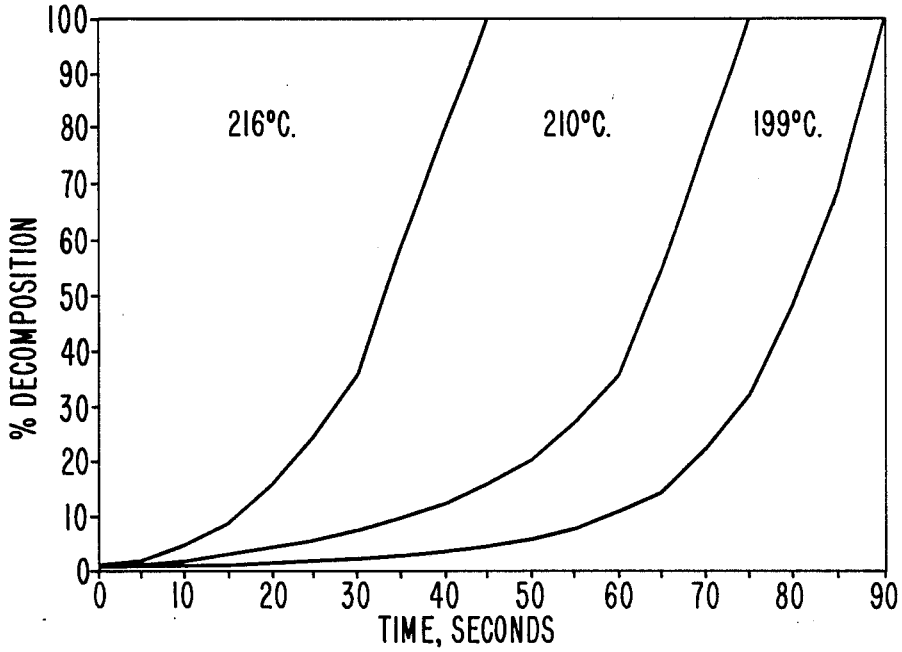
FIG. 7 is a graph of percent decomposition versus time for the blowing agent azodicarbonamide, plotted at different temperatures.

Examples of suitable blowing agents which satisfy the demands of the present invention by forming only minor amounts of gas at temperatures up to about 120°-125° C. and during the heat-sealing operation, while being able to generate a significant amount of gas when the food package is exposed to microwave heating conditions include p-toluenesulfonylhydrazide, p,p-oxybis(benzenesulfonylhydrazide), azodicarbonamide, p-toluenesulfonylsemicarbazide and 5-phenyltetrazole. All of these compounds form nitrogen gas when heated to an elevated temperature. However, none of these compounds form appreciable quantities of nitrogen gas when heated for prolonged times at temperatures below about 120° C. or during the conditions encountered during heat sealing operations. FIGS. 4 and 6 show the gas volume generated by p,p-oxybis(benzenesulfonylhydrazide) and azodicarbonamide, respectively. FIG. 4 shows that very little nitrogen gas is liberated until p,p-oxybis(benzenesulfonylhydrazide) is heated to a temperature above 140° C. Likewise, FIG. 6 shows that substantially no nitrogen gas is formed until azodicarbonamide is heated to temperature above 200° C. FIGS. 5 and 7 present graphs showing the percentage decomposition of these compounds over time at various elevated temperatures.

Those skilled in the art will appreciate other compounds which satisfy the time/temperature requirements described above and which form gases which are unobjectionable from a food contamination standpoint and thus can aslo be used as blowing agents in the present invention.

The resin layer 15 should contain about 2-50% by weight of the above-identified blowing agents based on the heat-releasable resin. More preferably, the amount of blowing agent will be about 2 to 10% by weight, and most preferably about 3 to 5% by weight. A suitable amount of blowing agent for any particular package design materials of construction can be determined routine experimentation.

When the blowing agent is incorporated into the heat-sealable resin layer in the above-identified amounts, a sufficient amount of gas is formed by the heating of the microwave interactive material during microwave heating to cause a permanent degradation in the seal. The gas generated during microwave heating forms bubbles 18 in the heat-sealable resin layer 15 adjacent the annular heat seal 16 which has been softened during its exposure to microwave energy. The gas bubbles act as faults in the seal, degrading its integrity. The formation of the gas bubbles therefore is effective to degrade or destroy the seal 16, thereby causing the package 10 to open during the microwave heating process.

An important characteristic of the present invention is that the microwave releasable seal have a microwave interactive material in close proximity to a heat-sealable resin layer which contains a blowing agent. The microwave interactive material becomes hot when the package 10 is exposed to microwave energy. The heating of the microwave interactive material softens the resin layer and also heats the blowing agent to a temperature where it begins to release gas, for example due to decomposition. The formation of the gas in the heat-sealable resin layer 15 destroys the integrity of the heat-seal 16 causing the container 10 to open during the microwave cooking process.

Foods which may be prepared in the container of the present invention include any food product which can be cooked in a microwave oven. The container of the present invention is particularly well suited for packaging liquid food products to be heated in a microwave oven, i.e. products such as soups, stews and food products with gravy, and particularly what are known in the art as shelf stable food products. These products can be stored for extended periods under non-frozen and often under non-refrigerated conditions without spoilage. Typical microwave heating times for shelf-stable products range from 2-4 minutes.

The container of the present invention also is useful for cooking those food products which need to be vented during cooking. In cooking such foods it is often desirable to have a container which is self-venting. The container 10 of the present invention is effective to vent the steam generated from the cooking process once seal 16 opens under microwave exposure. The release of this vapor aids also in the browning and crispening of surfaces of certain foods.

The food package with the selectively microwave releasable seal of the present invention is not limited to the uses mentioned above. The package of the present invention can also be used in any application where a seal is desired which becomes releasable in response to microwave energy. Such other applications include popcorn bags and the like.

The food package of the present invention provides for a maximum heat sealed area between the food tray and its lid, thus maximizing the integrity and high peel adhering of the seal during heat processing of the package and providing the consumer with satisfactory evidence of package integrity. Any effort to open the package prior to exposure to microwave energy would irreparably alter the fused seal.

There are many possible ways to prepare the package of this invention, and many different geometries and configurations are possible. Thus, while certain specific embodiments of the invention have been described with particularity herein, it will be recognized that various modifications thereof will occur to those skilled in the art and it is to be understood that such modifications and variations are to be included within the preview of this application and the spirit and scope of the appended claims.

I claim:

1. A food package which is useful for heating a food product in a microwave oven, said package comprising in combination:

(a) a tray containing the food product before and during microwave heating, the tray having a continuous sealing surface which defines an opening for introducing the food product into the tray and for removing the food product therefrom;

(b) a closure covering the opening of said tray; and (c) a microwave releasable adhesive seal in heat sealed contact with the continuous sealing surface of the tray and with the closure sealing the food product in said tray;

said microwave releasable adhesive seal comprising a microwave interactive material in close proximity to a heat-sealable resin containing a blowing agent which forms a gas during microwave heating of the package; wherein the seal is selectively releasable upon exposure of the package to microwave energy and resultant heating of the food product under microwave heating conditions.

2. The package of claim 1, wherein said closure is comprised of a material selected from the group consisting of paper, paperboard, polyester, polypropylene and polyethylene.

3. The package of claim 1, wherein said closure includes an oxygen barrier material.

4. The package of claim 1, wherein the tray is comprised of a material selected from the group consisting of paper, paper board, polyester, polypropylene and polyethylene.

5. The package of claim 1, wherein said tray includes an oxygen barrier material.

6. The package of claim 1, wherein the continuous sealing surface of said tray comprises an annular flange around said opening, said closure being sealed to the annular flange.

7. The package of claim 1, wherein the microwave interactive material comprises metallic flakes, and said flakes are dispersed or embedded in said heat-sealable resin layer.

8. The package of claim 7, wherein the microwave interactive material comprises metallic flakes selected from the group consisting of aluminum, nickel, antimony, copper, molybdenum, iron, chromium, tin, zinc, silver, gold and alloys thereof.

9. The package of claim 8, wherein said metallic flakes are composed of aluminum.

10. The package of claim 7, wherein the microwave interactive material comprises about 5–80% by weight of the heat-sealable resin and microwave interactive material dispersion.

11. The package of claim 1, wherein the microwave interactive material is coated on said closure.

12. The package of claim 1, wherein the microwave interactive material is coated on the continuous sealing surface of said tray.

13. The package of claim 1, wherein the blowing agent is selected from the group consisting of p-toluenesulfonylhydrazide, p,p-oxybis(benzenesulfonylhydrazide), azodicarbonamide, p-toluenesulfonylsemicarbazide and 5-phenyltetrazole.

14. The package of claim 13, wherein the heat-sealable resin contains about 2–50% by weight of blowing agent based on the weight of said resin.

15. In a method of making a packaged food product suitable for heating in a microwave oven which comprises:

(a) providing a tray having a continuous sealing surface which defines an opening into the tray and a closure for sealing the opening of said tray, (b) introducing food into the tray through said opening;

(c) covering said opening with the closure and heat sealing the closure to said continuous sealing surface of the tray to seal the food product within the tray; and (d) heat processing the sealed container, the improvement comprising:

sealing the closure to said continuous sealing surface with a heat-sealable resin containing a blowing agent and, providing a microwave interactive material in close proximity to the heat-sealable resin, the blowing agent being able to form a gas during microwave heating of the packaged food product but being substantially unable to form a gas during heat sealing of the closure and during heat processing of the packaged food product.

16. The method of claim 15, wherein the microwave interactive material is provided in an amount of about 5–400% by weight of the heat-sealable resin.

17. The method of claim 16, wherein the microwave interactive material comprises aluminum flakes.

18. The method of claim 15, wherein the blowing agent forms a gas selected from the group consisting of nitrogen, carbon dioxide and oxygen.

19. The method of claim 15, wherein the blowing agent forms the gas at a temperature of above about 120° C.

20. The method of claim 15, wherein the blowing agent is selected from the group consisting of p-toluenesulfonylhydrazide, p,p-oxybis(benzenesulfonylhydrazide), azodicarbonamide, p-toluenesulfonylsemicarbazide and 5-phenyltetrazole.

21. The method of claim 20, wherein the heat-sealable resin layer contains about 2–50% by weight of the blowing agent based on the weight of said resin.

22. A process for heating foods in a microwave over which comprises placing food contained in the package of claim 1 into a microwave oven and operating said oven for a time sufficient to heat said food.

23. The package of claim 14 wherein said microwave releasable adhesive seal has a peel strength of at least about 1000 N/m before said package is exposed to microwave energy.

24. The package of claim 23 wherein said peel strength is at least about 2000 N/m.

25. The package of claim 24 wherein said food product contains a liquid.

26. The package of claim 25 wherein said food product is soup.

27. The package of claim 1 wherein said heat-sealable resin is a propylene resin, said blowing agent is p,p-oxybis(benzenesulfonylhydrazide) and said microwave interactive material is coated on said clouse.

* * * * *